US006543854B1

(12) United States Patent
Finch

(10) Patent No.: US 6,543,854 B1
(45) Date of Patent: Apr. 8, 2003

(54) DETACHABLE WHEELCHAIR LEG REST

(75) Inventor: Thomas E. Finch, San Antonio, TX (US)

(73) Assignee: Teftec Corporation, San Antonio, TX (US)

( * ) Notice: Subject to any disclaimer, the term of this patent is extended or adjusted under 35 U.S.C. 154(b) by 0 days.

(21) Appl. No.: 09/818,971

(22) Filed: Mar. 27, 2001

Related U.S. Application Data

(60) Provisional application No. 60/192,303, filed on Mar. 27, 2000.

(51) Int. Cl.[7] ..... A47C 20/00

(52) U.S. Cl. ..... 297/423.37; 297/423.35; 280/304.1

(58) Field of Search ..... 297/423.37, 423.35, 297/423.6, 423.29; 280/304.1, 291

(56) References Cited

U.S. PATENT DOCUMENTS

| | | | | |
|---|---|---|---|---|
| 3,857,606 A | | 12/1974 | Rodaway | 297/429 |
| 4,176,879 A | | 12/1979 | Rodaway | 297/429 |
| 4,722,572 A | | 2/1988 | Sata | 297/433 |
| 4,770,467 A | | 9/1988 | Zinn | 297/429 |
| 4,988,114 A | * | 1/1991 | Thornton, Jr. et al. | 280/304.1 |
| 5,401,045 A | * | 3/1995 | Foerster et al. | 280/250.1 |
| 5,522,644 A | * | 6/1996 | Peek | 297/423.026 |
| 6,234,576 B1 | * | 5/2001 | Fleigle | 297/423.37 |

* cited by examiner

*Primary Examiner*—Peter M. Cuomo
*Assistant Examiner*—Stephanie Harris
(74) *Attorney, Agent, or Firm*—Cox & Smith Incorporated

(57) ABSTRACT

An improved leg rest hinge structure for a wheelchair that is both strong and easily manipulated. The hinge structure includes a hinge post inversely mounted to a hinge cap which retains the leg tube and foot plate of the leg rest. The hinge post is removably and rotationally inserted into a cylindrical socket fixed to the frame of the wheelchair. A flat land is formed on the exterior circumference of the cylindrical socket that engages either a matching land formed on the underside of the hinge cap or a spring loaded pivot plate fixed on the hinge cap adjacent the hinge post. The structure provides a rugged single post hinge point and an easily manipulated mechanism for releasing the leg rest for rotating it to the side and out of the way.

1 Claim, 4 Drawing Sheets

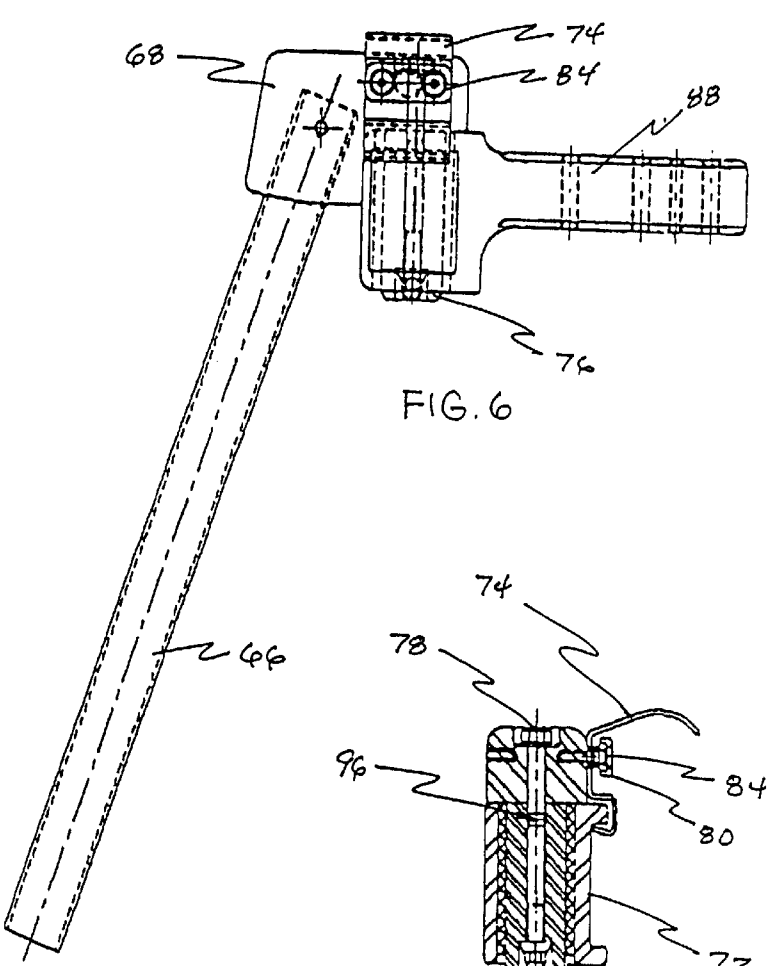
FIG. 6
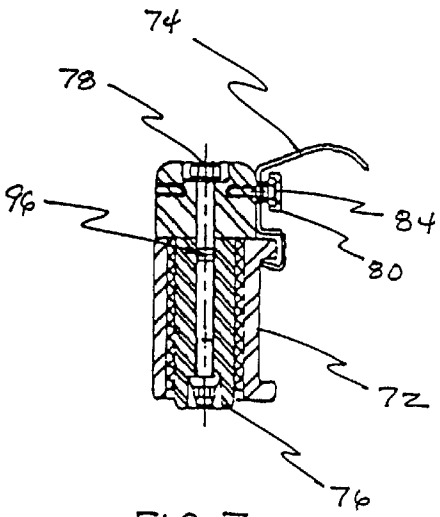
FIG. 7
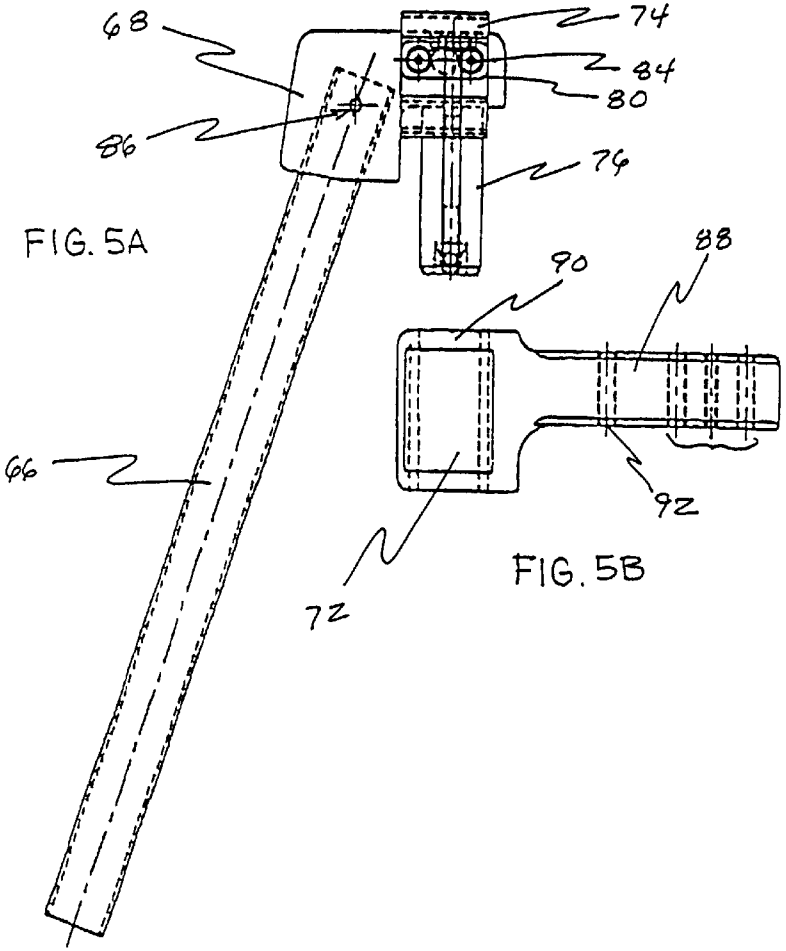
FIG. 5A
FIG. 5B

DETACHABLE WHEELCHAIR LEG REST

RELATIONSHIP TO PRIOR APPLICATIONS

The present application claims the benefit of the filing date of U.S. Provisional Patent Application Ser. No. 60/192,303 filed Mar. 27, 2000.

BACKGROUND OF THE INVENTION

1. Field of the Invention

The present invention relates generally to components and attachments for wheelchairs. The present invention relates more specifically to mechanisms for rotational and removable attachment of a leg rest to a wheelchair.

2. Description of the Related Art

Early examples of efforts to attach leg and foot rests to wheelchairs in a manner that permits their rotation to the side include the following patents:

U.S. Pat. No. 4,176,879 issued to Rodaway on Dec. 4, 1979 entitled Wheelchair Foot Rest Latch describes a foot rest hinge structure that includes two support pin hinge points and a third retractable pin latch point. The type of hinge system described places considerable wear on two relatively weak pivot points and further requires significant manipulation by the user to release.

U.S. Pat. No. 4,770,467 issued to Zinn on Sep. 13, 1988 entitled Foot Rest Unit for Wheelchairs describes a tubular hinge arrangement that provides a much stronger pivot point but requires, as a result, a much more complicated release mechanism. In this case the release mechanism comprises four buttons (on each leg rest) that must be depressed against a spring in order to release and rotate the leg rest.

FIGS. 1*a* and 1*b* attached hereto shows a more recent effort to provide stability and strength to a releasable/rotating leg rest. FIG. 1*a* is a side view showing in schematic form the basic structure of this common leg rest system used in the prior art. FIG. 1*b* is a top view of the same components of the leg rest system shown in FIG. 1*a*. In FIG. 1*a*, foot rest 10 is comprised of foot plate 16 connected by leg tube 12 to hanger bracket 14. Hanger bracket 14 is a cap structure that receives and retains leg tube 12 as well as hinge post 18. Foot rest 10 is received by frame sleeve 24 which is rigidly fixed on the frame of the wheelchair (not shown). Frame sleeve 24 positions sleeve tube 22 with cylindrical opening 28 so as to receive hinge post 18 therein. Hinge post 18 and opening 28 are sized for a snug but rotatable fit.

To direct foot rest 10 towards the front to its most common position suitable for receiving the foot of the user, hinge post 18 in the prior art is fixed with a pair of opposing pins 20 that engage depressions 26 formed in sleeve tube 22. In this manner foot rest 10 may be moved to the side by forcing the rotation of hinge post 18 within sleeve tube 22 such that pins 20 are forced up and out of depressions 26. Release of the foot rest and rotation back towards the front allows pins 20 to once again fall into depressions 26 and to be held loosely captive therein.

Two primary problems arise with each of the above designs in the prior art. The first problem results from a hinge mechanism that is weak and therefore susceptible to breakage and/or excessive wear. The second problem results from a hinge mechanism that is difficult for the user of the wheelchair to manipulate. Unfortunately it has been difficult to address both of these problems at the same time as rugged hinge mechanisms tend to be difficult to manipulate and easily manipulated hinges tend to break or wear excessively.

It would be desirable to have a leg rest hinge assembly that is both rugged and resistant to breakage and wear, and at the same time is easily manipulated by the user. It would be desirable if such a leg rest hinge structure had a wide range of rotation when released but a firm fixed retention when engaged. It would further be desirable if such a leg rest structure could be adapted for retrofit to existing wheelchairs with minimal modifications to the wheelchair frame.

SUMMARY OF THE INVENTION

It is therefore an object of the present invention to provide a leg rest for a wheelchair that may be alternately fixed in a forward position or a side rotated position.

It is an object of the present invention to provide a rotating leg rest for a wheelchair having a hinge mechanism that is of rugged construction such that it resists breakage and wear during repeated use.

It is a further object of the present invention to provide a rotating leg rest for a wheelchair having a releasable latch mechanism tending to position the leg rest in a forward position for use but releasable to permit rotation to the side during non-use.

It is a further object of the present invention to provide a rotating leg rest for a wheelchair having a releasable latch mechanism that itself is rugged and resistant to breakage and yet is easily manipulated by the wheelchair user.

In fulfillment of these and other objectives the present invention provides an improved leg rest hinge structure for a wheelchair that is both strong and easily manipulated. The hinge structure includes a hinge post inversely mounted to a hinge cap which retains the leg tube and foot plate of the leg rest. The hinge post is removably and rotationally inserted into a cylindrical socket fixed to the frame of the wheelchair. A flat land is formed on the exterior circumference of the cylindrical socket that engages either a matching land formed on the underside of the hinge cap or a spring loaded pivot plate fixed on the hinge cap adjacent the hinge post. The structure provides a rugged single post hinge point and an easily manipulated mechanism for releasing the leg rest for rotating it to the side and out of the way.

BRIEF DESCRIPTION OF THE DRAWINGS

FIGS. 5*a* and 5*b* are partial cross sectional side views of the hinge components of the present invention in a separated configuration.

FIG. 6 is a partial cross sectional side view of the hinge components of the present invention in a combined configuration.

FIG. 7 is a detailed cross sectional view of the pivoting hinge section and the latch mechanist of the present invention.

DETAILED DESCRIPTION OF THE PREFERRED EMBODIMENTS

Figure 1:
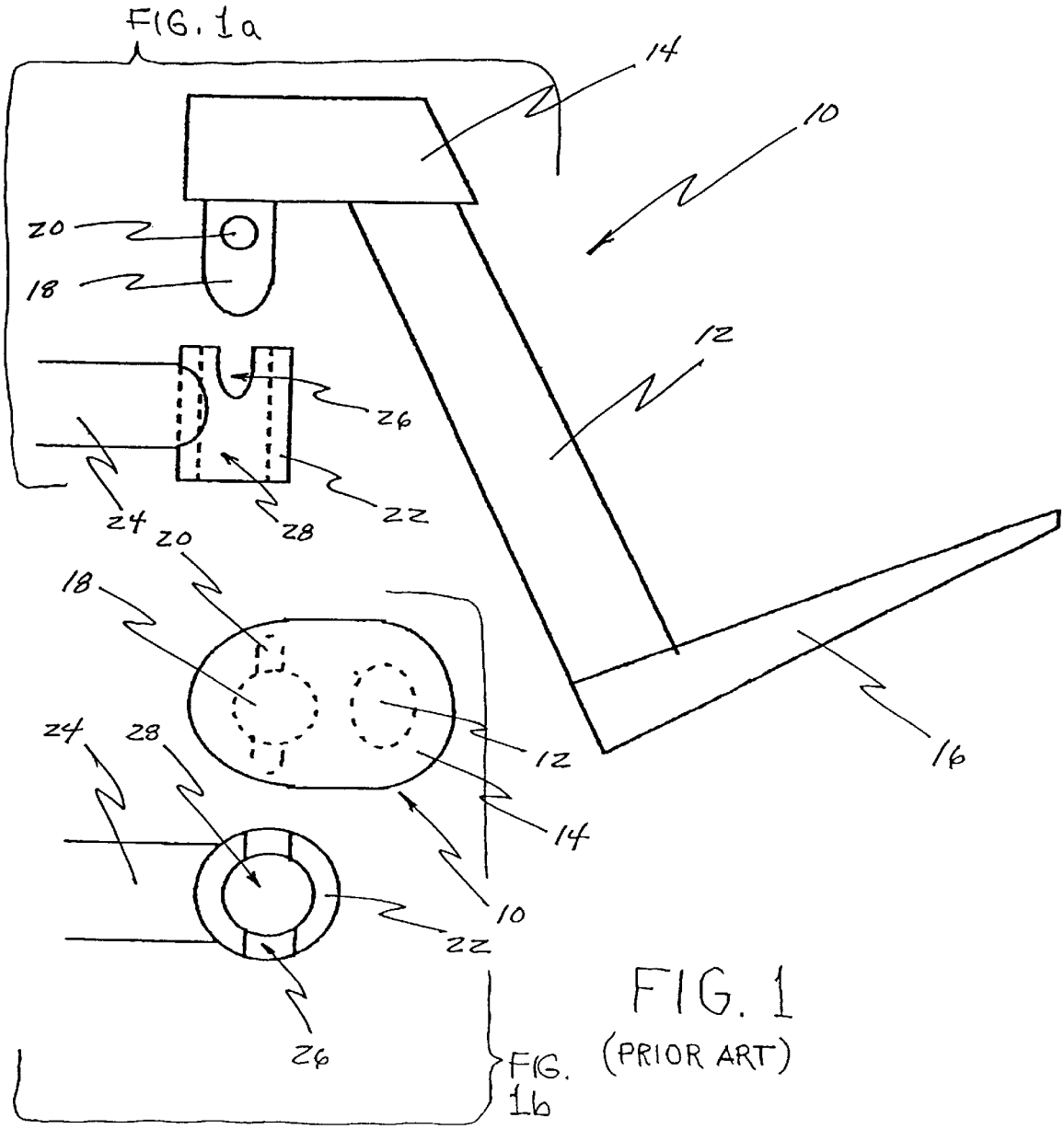
FIG. 1 (PRIOR ART)
FIGS. 1*a* and 1*b* are side and top schematic views of a hinge mechanism in prior art.
Figure 2:
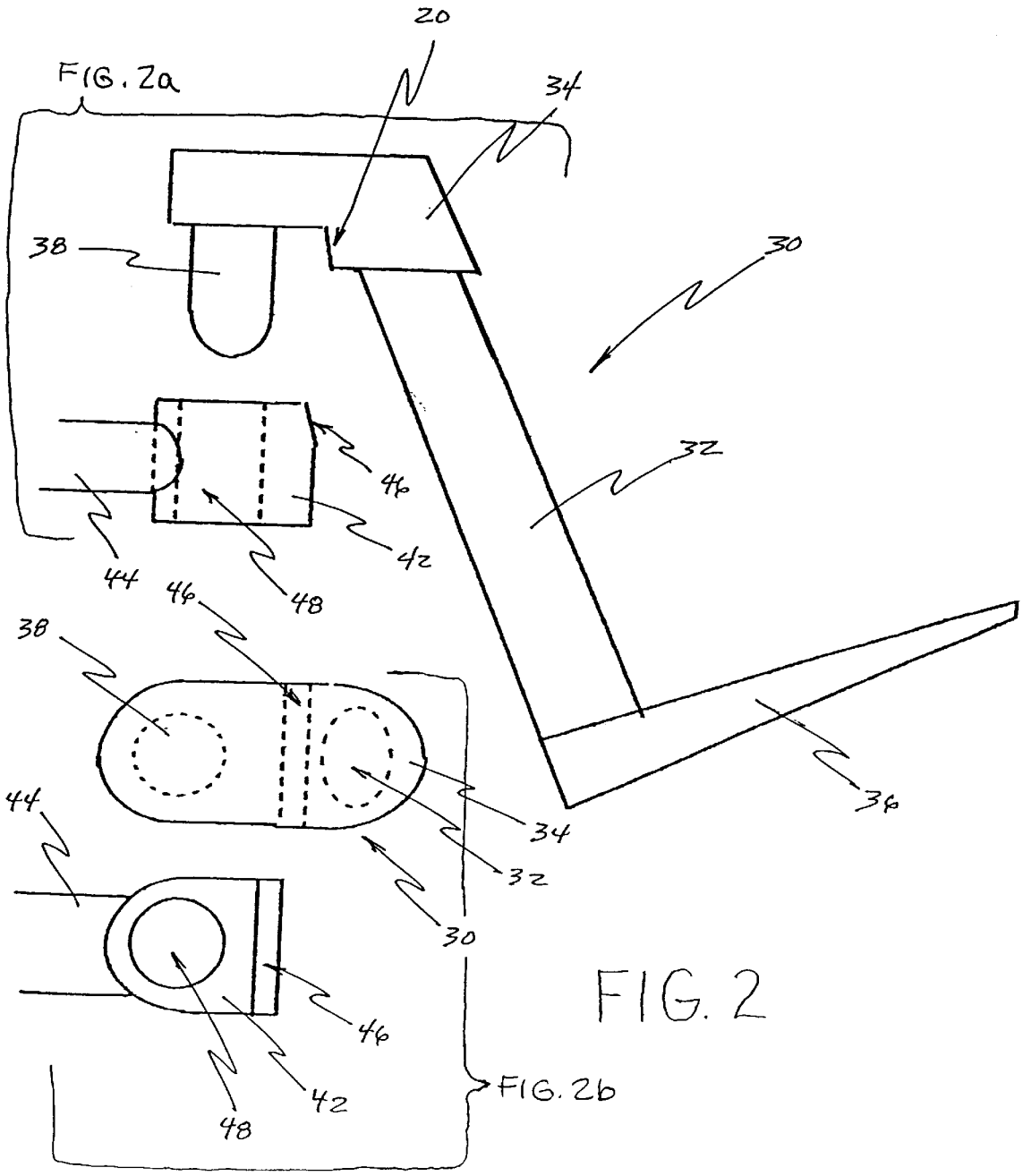
FIGS. 2*a* and 2*b* are side and top schematic views of the basic hinge structure of the present invention.

Reference is made to FIGS. 2*a* and 2*b* for a description of the generic structure of the present invention shown in schematic form, primarily for comparison with prior art FIGS. 1*a* and 1*b*. As with FIG. 1*a*, FIG. 2*a* is a side view showing in schematic form the basic structure of the present invention highlighting its departure from the prior art. FIG. 2*b* is a top view of the same components of the leg rest system shown in FIG. 2*a*. In FIG. 2*a*, leg rest 30 is comprised of foot plate 36 connected by leg tube 32 to hanger bracket 34. Hanger bracket 34 is a cap structure that receives and retains leg tube 32 as well as hinge post 38. Leg rest 30 is received by frame sleeve 44 which is rigidly fixed on the frame of the wheelchair (not shown). Frame sleeve 44 positions sleeve tube 42 with cylindrical opening 48 so as to receive hinge post 38 therein. Hinge post 38 and opening 48 are sized for a snug but rotatable fit.

Unlike the prior art, hinge post 38 does not retain indexing pins that might be broken or sheared off through repeated use. Instead, sleeve tube 42 is configured with a flat land surface 46 that matches and engages with a flat land face 20 on hanger bracket 34. Flat land surface 46 and flat land face 20 engage only when leg rest 30 is directed in a forward orientation. Rotation to either side forces hinge post 38 slightly up out of opening 48 in a manner that makes leg rest 30 slightly, rotationally unstable. In other words, the only stable orientation of leg rest 30 is when it is directed forward as a result of the engagement of flat land surface 46 with flat land face 20.

Figure 3:
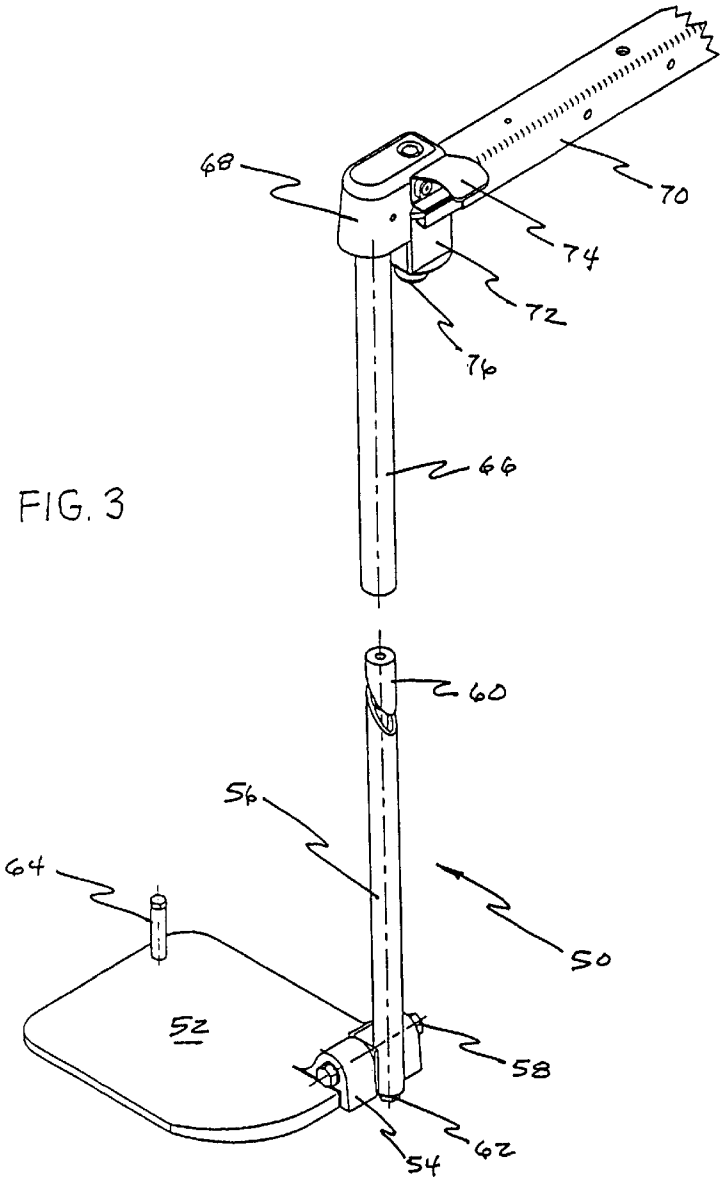
FIG. 3 is an exploded perspective view of the preferred embodiment of the present invention.

Reference is now made to FIG. 3 for a more detailed description of the components of the leg rest of the present invention. The basic concept of using a flat land surface engaging with a flat land face is carried through to the specific embodiment shown in FIG. 3. Leg rest 50 is comprised of foot plate 52 which is hingedly attached to first leg tube section 56 by way of hinge 54. Hinge pin 58 secures first leg tube section 56 to foot plate 52 in this manner. Adjustment wedge 60 at one end of first leg tube 56 permits telescoping movement of first leg tube 56 within second leg tube 66. Tightening longitudinal bolt 62 within first leg tube section 56 draws wedge 60 downward to set first leg tube section 56 in position within second leg tube section 66. Retention pin 64 is positioned in foot plate 52 in order to facilitate the retention of the user's foot on the leg rest.

Second leg tube section 66 is retained by hinge cap 68. Also retained in hinge cap 68 is hinge post 76 as described in more detail below. Sleeve arm 72 extends from wheel chair frame 70 to receive and retain hinge post 76 therein. Release latch 74 fixes or releases th rotation of leg rest 50 as described in more detail below.

Figure 4:
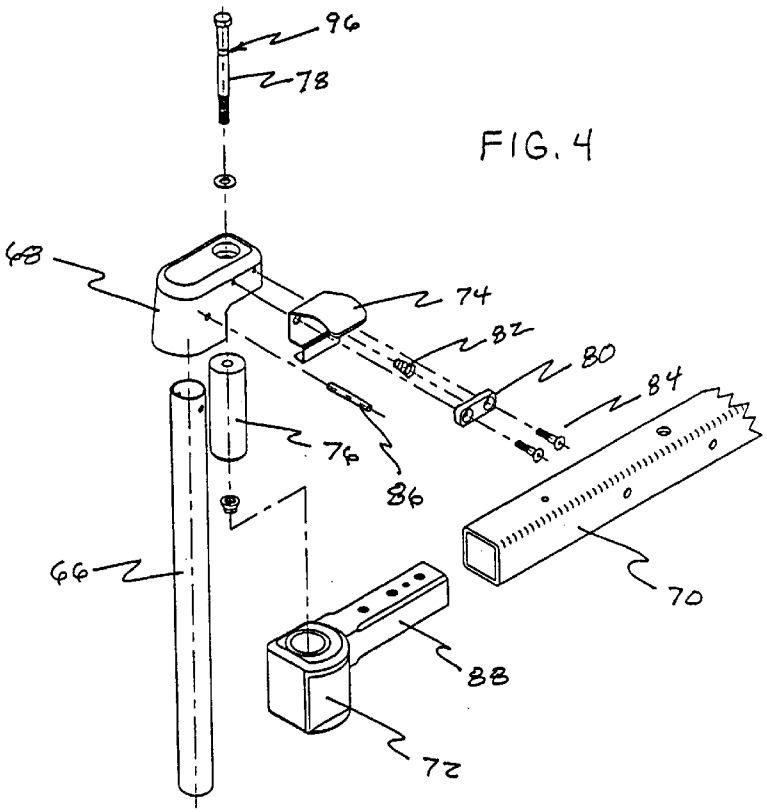
FIG. 4 is an exploded perspective detail view of the hinge and latch mechanisms of the present invention.

Reference is now made to FIG. 4 for a more detailed description of the components of the hinge mechanisms of the present invention. In FIG. 4 only second leg tub section 66 is shown as it is inserted into and fixed by pin 86 within hinge cap 68. Likewise hinge post 76 is inserted and fixed in hinge cap 68 by means of bolt 78 as shown. Bolt 78 includes calibrated failure groove 96 for purposes described in more detail below.

Fixed to the side of hinge cap 68 is releasable latch 74 which is pivotally retained in place by means of spring 82, bridge clip 80, and screws 84. Releasable latch 74 is positioned and oriented to engage a flat land surface on frame sleeve 72 as shown in FIG. 4. Frame sleeve 72 is configured with sleeve arm 88 which is inserted into and retained by standard configuration wheelchair frame members.

FIGS. 5*a* and 5*b* show in assembled detail the same components described and shown above in conjunction with FIG. 4. In this view, the attachment of second leg tube section 66 and hinge post 76 to hinge cap 68 is more clearly shown. In addition, it can be seen from FIGS. 5*a* and 5*b* how hinge post 76 may be removably inserted into frame sleeve 72 through aperture 90 which matches the geometry of hinge post 76. Apertures 92 positioned through sleeve arm 88 are placed for purposes of retaining sleeve arm 88 within the wheelchair frame (not shown).

FIG. 6 discloses in partial cross sectional d tail the assembled structure shown generally in FIGS. 5*a* and 5*b*. In this view, it is seen how hinge post 76 fully engages aperture 90 in frame sleeve 72. Likewise, releasable latch 74 engages the flat land surface of frame sleeve 72 on one side thereof. FIG. 7 discloses in greater cross sectional detail the manner in which releasable latch 74 is retained on hinge cap 68 for engagement with the flat land surface of frame sleeve 72. Releasable latch 74 pivot along spring loaded bridge clip 80 to alternately engage or disengage flat land surface on frame sleeve 72. Again as described above, hinge post 76 is attached to hinge cap 68 by means of bolt 78. Bolt 78 incorporates calibrated failure groove 96 at a point that permits bolt 78 to break off when excessive torque is placed on the leg rest. In the prior art, excessive force often resulted in irreparable damage to the complete hinge mechanism. Bolt 78, being a much less costly and easier component to replace, is preferably damaged in this manner as opposed to the hinge post itself.

Manipulation of releasable latch 74 requires little more than the movement of the user's hand or arm up under that portion of the latch that extends outward from the hinge assembly. Lifting this portion of the latch tilts or rocks the releasable latch upward so that it disengages from the flat land surface on frame sleeve 72 as described above. This momentary release of the latch permits rotation of the leg rest to the side and out of the way of the user.

It is understood that the configuration shown in FIGS. 3 through 7 represents the left side leg rest appropriate for use in conjunction with a typical wheelchair. A mirror image construction of the leg rest assembly shown in the figures would be utilized in conjunction with the right side of the wheelchair. It should also be noted that the structure for receiving the hinge assembly of the present invention shown in the drawing figures is typical of wheelchair frames such that retrofitting the hinge assembly of the present invention to existing wheelchairs requires little or no modification to the frame.

Many features and advantages of the present invention are discernable from the detailed specification and the attached figures. It is therefore intended by the appended claims to cover all such features and advantages of the invention that fall within the spirit and scope of the invention. Furthermore, since numerous modifications and variations will readily occur to those skilled in the art, it is not desired that the present invention be limited to the exact construction and operation illustrated and described herein. Accordingly therefore, all suitable modifications and equivalents that may be resorted to are intended to fall within the scope of the claims. Although the invention has been described with reference to specific embodiments, this description should not be construed as limiting. Various modifications of the disclosed embodiments, as well as alternative embodiments of the inventions will become apparent to persons skilled in the art upon reference to the description of the invention. It is, therefore, contemplated that the appended claims will cover such modifications that fall within the scope of the invention.

I claim:

1. A hinged foot rest assembly for a wheelchair, the assemble comprising:

(a) a foot plate;

(b) a leg tube having first and second ends and a longitudinal axis, said leg tube hingedly attached to said foot plate at said first end of said leg tube and supporting said foot plate in a plane generally orthogonal to said longitudinal axis of said leg tube;

(c) a cap fixed to and retaining said second end of said leg tube, said cap comprising a first external land face;

(d) a pivot post fixed to and extending from said cap adjacent said leg tube and having a diameter and a longitudinal axis of said pivot post extending from said cap in generally the same direction as said longitudinal axis of said leg tube; and (e) a sleeve arm defining a cylindrical sleeve for receiving said pivot post along said longitudinal axis thereof, said sleeve having a diameter incrementally larger than said diameter of said pivot post to permit rotational movement of said pivot post within said sleeve, said sleeve arm fixed to a frame of said wheelchair, said sleeve arm further comprising a second external land face positioned such that when said pivot post is received in said cylindrical sleeve, said first external land face of said cap contacts and engages said second external land face so as to retard rotational movement of said pivot post within said cylindrical sleeve.

* * * * *

UNITED STATES PATENT AND TRADEMARK OFFICE

CERTIFICATE OF CORRECTION

PATENT NO. : 6,543,854 B1
DATED : April 8, 2003
INVENTOR(S) : Thomas E. Finch

It is certified that error appears in the above-identified patent and that said Letters Patent is hereby corrected as shown below:

Column 2,
Line 44, "hinge mechanism in prior art." should be -- hinge mechanism in the prior art. --
Line 59, "mechanist" should be -- mechanism --

Column 4,
Line 6, "d tail" should be -- detail --
Line 14, "pivot" should be -- pivots --

Column 5,
Line 11, "longitudinal axis of said pivot post extending from said" should be
-- longitudinal axis, said longitudinal axis of said pivot post extending from said --

Signed and Sealed this

Nineteenth Day of August, 2003

JAMES E. ROGAN
*Director of the United States Patent and Trademark Office*